United States Patent [19]

Nemec et al.

[11] 4,292,915

[45] Oct. 6, 1981

[54] OCEAN-GOING BARGE CARRIER

[75] Inventors: Frank A. Nemec, New Orleans, La..

[73] Assignee: Lykes Bros. Steamship Co., Inc., New Orleans, La.

[21] Appl. No.: 574,523

[22] Filed: Jul. 7, 1966

Related U.S. Application Data

[60] Division of Ser. No. 508,631, Oct. 22, 1965, Pat. No. 3,318,276, which is a continuation-in-part of Ser. No. 416,053, Dec. 4, 1964, abandoned.

[51] Int. Cl.[3] ..... B63B 35/40

[52] U.S. Cl. ..... 114/260; 406/39

[58] Field of Search ..... 114/43.5, 72, 259, 260; 214/15; 414/138, 140; 406/39

[56] References Cited

U.S. PATENT DOCUMENTS 2,942,425 6/1960 DeLong et al. ..... 114/43.5 X

FOREIGN PATENT DOCUMENTS 689310 3/1953 United Kingdom ..... 114/43.5

*Primary Examiner*—Trygve M. Blix
*Assistant Examiner*—Jesus D. Sotelo

[57] ABSTRACT

A marine carrier that comprises a hull, a plurality of loading decks, an opening through the hull on the level of each of the decks sufficiently large to permit loading barges through each opening into and out of each storage deck.

5 Claims, 15 Drawing Figures

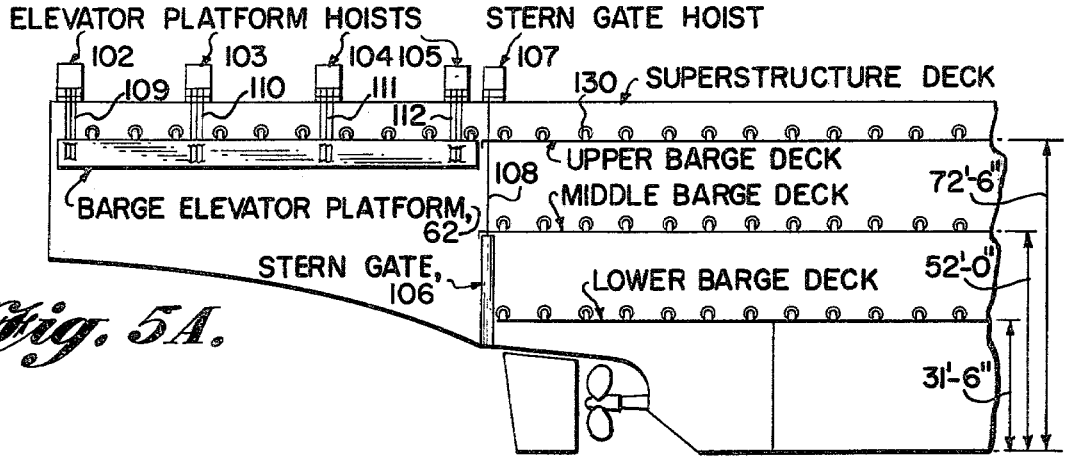
Fig. 5A.
Fig. 5B.
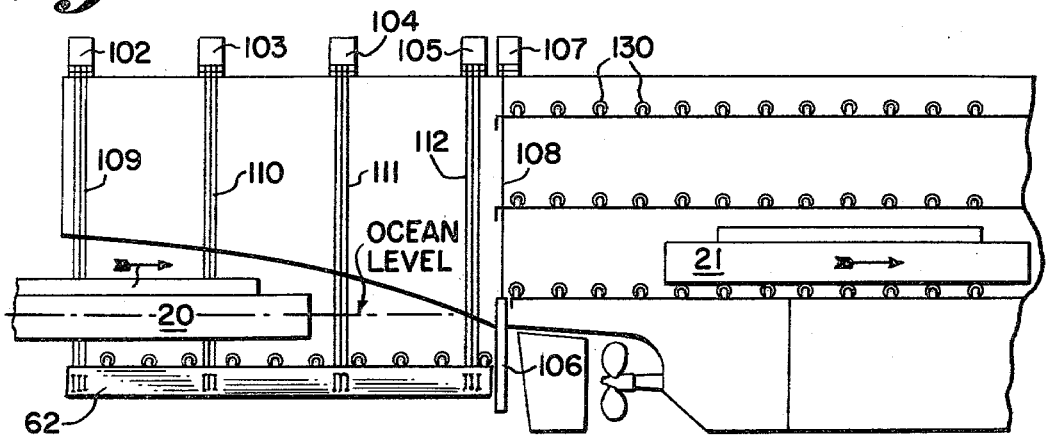
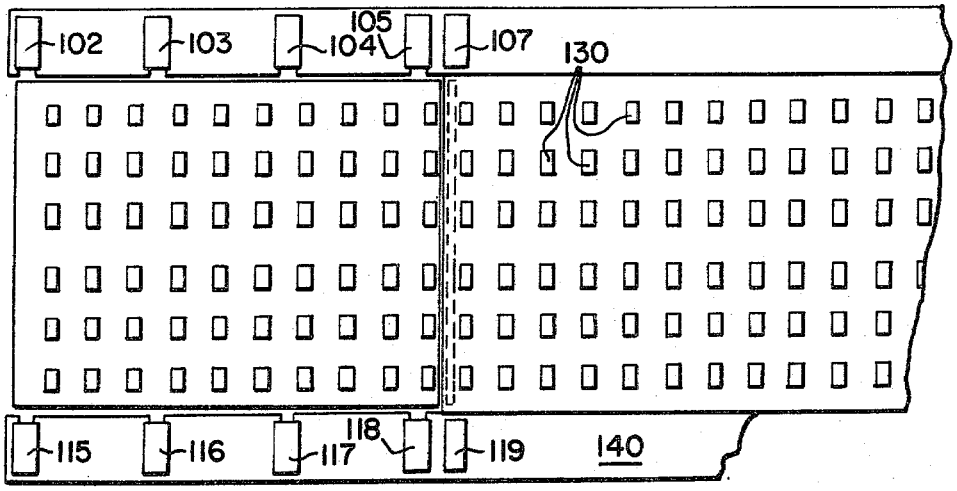
Fig. 6.

Fig. 7.
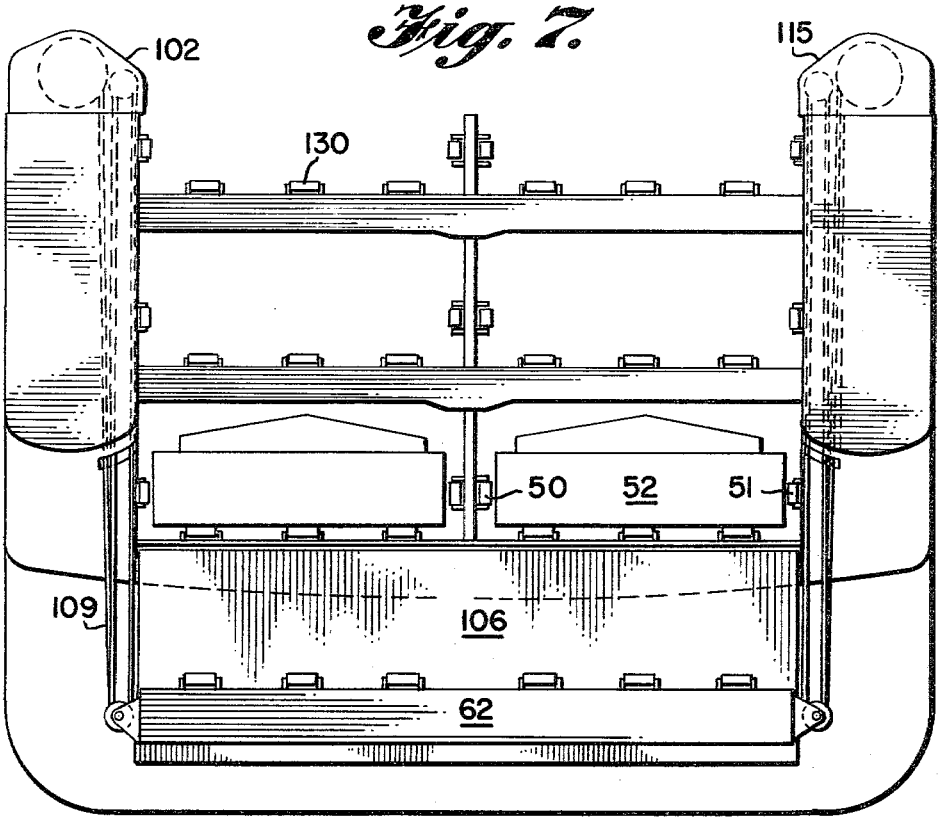
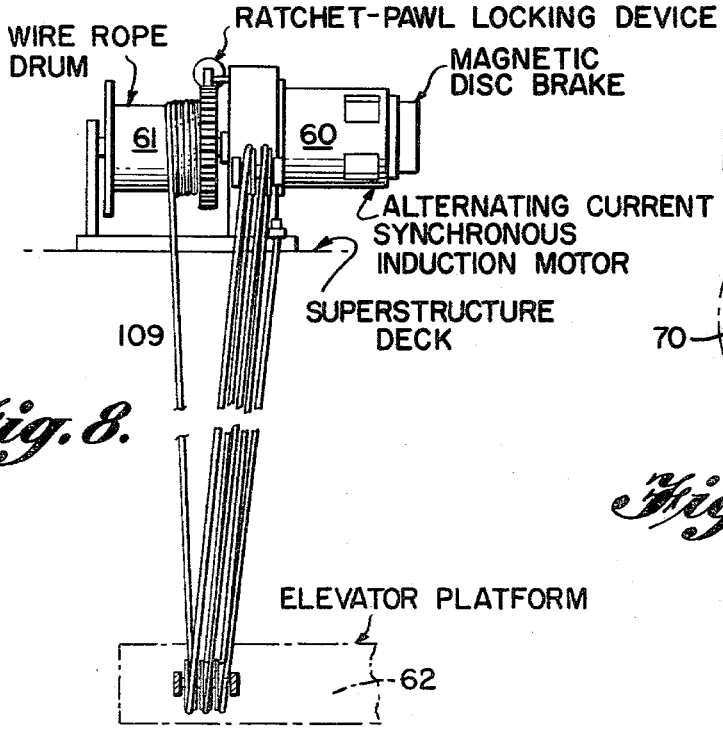
Fig. 8.
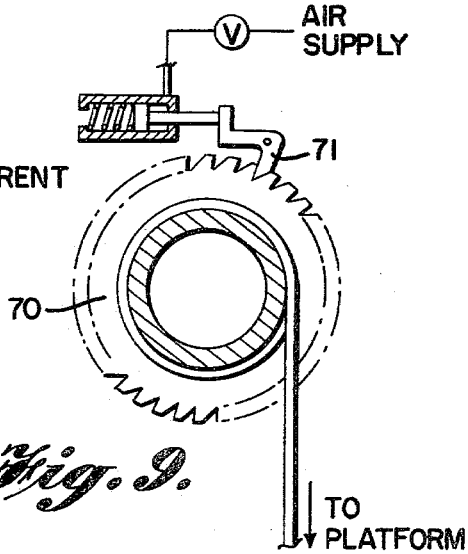
Fig. 9.

OCEAN-GOING BARGE CARRIER

This application is a division of application Ser. No. 508,631 filed Oct. 22, 1965 now U.S. Pat. No. 3,318,276 which is a continuation-in-part of application Ser. No. 416,053 filed Dec. 4, 1964 now abandoned.

This invention relates to a marine carrier and, more specifically, to an ocean-going ship constructed so that its cargo may consist of barges, that is to say, relatively small vessels suitable for inland or coastal waters. Its construction is such that numerous such barges may be on-loaded and off-loaded into and out of one of a plurality of decks of the ship before and after transport.

An object of this invention is to supply means by which barges of a variety of constructions and configurations may be transported across large bodies of water at greater economy.

Another object of this invention is to allow speed and ease in on-loading and off-loading trans-oceanic cargo.

Still another object of this invention is to provide means by which the stability of a multi-deck ocean-going vessel may be assured during submergence for on-loading and off-loading as well as at sea.

A further object of this invention is to provide an alternative method of on-loading and off-loading by which unusually deep submergence may be avoided.

Other more specific objects of this invention will appear as reference is made to the accompanying drawings, in which FIGS. 1–4 represent one embodiment and FIGS. 5A–14 represent a further embodiment.

FIG. 5A is a portion of a vertical, longitudinal cross-section through a carrier taken along its centerline showing an at-sea position of certain loading equipment.

FIG. 5B is a portion of a vertical, longitudinal cross-section through a carrier taken along its centerline showing a loading position of certain loading equipment.

FIG. 6 is a portion of an upper barge deck viewed from above showing an at-sea position for certain loading equipment.

FIG. 7 is a vertical, transverse cross-section through a carrier taken in a plane perpendicular to the centerline at a point near its stern.

FIG. 8 represents a syncrolift hoist.

FIG. 9 represents a locking device of a syncrolift.

Figure 1:
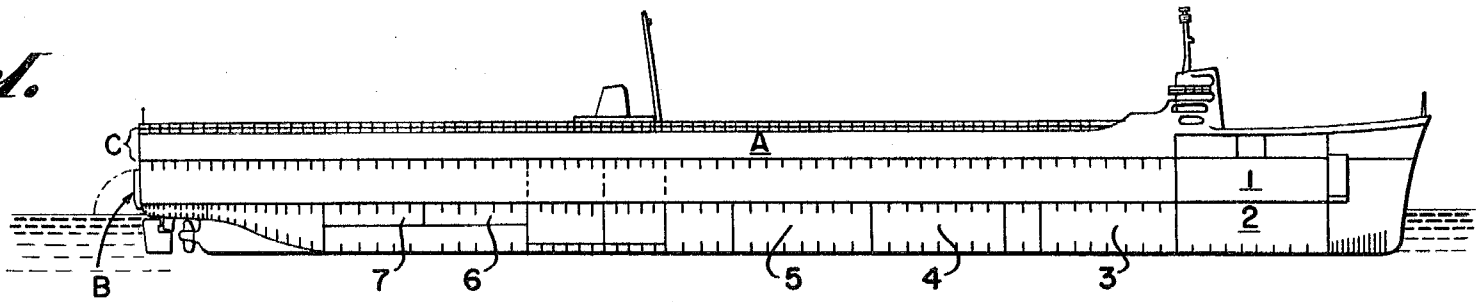
FIG. 1 represents a vertical, longitudinal cross-section through a carrier according to my invention taken along its center line.
Figure 2:
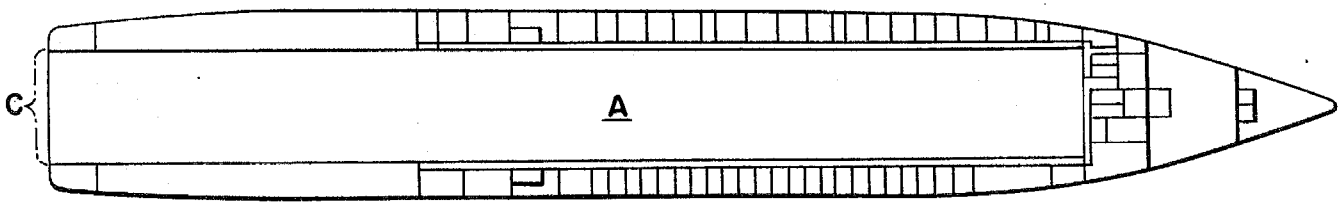
FIG. 2 is a horizontal sectional plan of the carrier of FIG. 1 taken at its second storage deck level.

The desirability of reducing the time involved in loading a cargo ship is great. As perhaps 50 percent of a ship's time is spent in port, a significant reduction of its loading time could free that ship to a much more productive operating schedule. The primary embodiment of this invention contemplates that a complete loading and unloading operation, including ballasting and deballasting, can be accomplished in approximately six to eight hours. This could reduce the typical cargo handling port time from 50 percent to 10 percent of a voyage.

As a result of a greater percentage of productive shipping time, fewer ships would be required to do the same amount of shipping. Hence, two barge carriers might prove able to carry the cargo load of four or more conventional cargo ships in the same overall shipping time.

Furthermore, the barge carrier would reduce cargo handling costs by allowing direct loading onto barges, with the likelihood that much of this cargo loading operation could be undertaken during straight time hours, thereby minimizing overtime and premium pay.

With the concept of this invention, barges of varying sizes and shapes can be handled from a limited number of gathering or terminal ports with coast-wire distribution being made by relatively inexpensive tugs, thereby enabling a large reduction in the number of ports of call. This is an additional factor of overall productivity increase of barge carriers over conventional ships, tending to further reduce the average transit time for cargo.

Previously, it had been suggested that barges be transported aboard ocean-going ships. In some cases, the barges were loaded into compartments on a deck level, limiting the sizes and shapes of the barges that could be handled as well as creating the problem of ballast balancing asymetrical loads of barges. In U.S. Pat. No. 1,533,776 to Tiburtius issued Apr. 14, 1925, a single large central deck well free of obstructions to movement and storage was proposed; and, even though an additional feature was that its loading opening was as wide as its well width, a necessary feature to the total disclosure was the cushioning of the cargo barge on water kept constantly at the outside water-line level during transportation by an unsealed opening in the loading gate which severely limited the size and shape of suitable barges due to the water-shifting problem. Additionally, as the solution to the water-shifting problem was the positioning of a number of adjustable doors to form smaller water compartments, the time consumed in positioning a cargo barge of slightly unusual shape was very wasteful.

A more recent disclosure by Baer in U.S. Pat. No. 2,134,352 issued Oct. 25, 1938, limited itself to cargo barges of the size and shape that could be floated through a loading opening much narrower than the width of the storage deck well.

All of these previous problems have been greatly alleviated by the present invention. Barges of greatly varying sizes and shapes can be loaded and transported, as such a unit of the greatest width capable of fitting within the storage deck well can be floated through the deck loading opening of at least the upper-most deck. The cargo barges can be positioned on the storage deck so that ballast balancing is minimized or eliminated, saving loading time. As this invention requires no water cushion for the transported barges, the water-shifting problem has been eliminated. This also eliminates the need for doors or other devices along the bulkheads enclosing the storage deck well, or elsewhere, to prevent water-shifting. Since there is no storage deck well water level to be kept at the level of the water outside the vessel, this outside water may be completely sealed off from the interior of the vessel, and a plurality of storage decks is made possible. Moreover, the overall simplicity of the storage deck configuration reduces necessary service and repair time to a minimum.

My invention is a marine carrier comprising a hull and a plurality of storage decks. Specifically, the carrier may be a ship or vessel of sufficient size and displacement to enable a safe ocean crossing. The external shape of the vessel is not a characteristic of the invention, but generally the more streamlined vessel is better suited to my purposes. However, any hull shape suitable to ocean travel is permissible. The number of storage decks suitable for storing cargo barges is dependent on the stability of the vessel and the other types of cargo sought to be transported. They can be open or closed to the weather so long as there is no danger of shipping water in dangerous quantities or sufficient means are provided to discharge this water. The upper-most deck may have a loading opening as wide as the width extremities of that storage deck well, so that the widest cargo unit that could be stored in the deck well can be floated into it. The lower decks are slightly more restricted, as the widest cargo unit that may be floated into their storage wells and positioned therein must be able to pass between one of the longitudinal bulkheads of that deck well and the mid-ships supporting stanchions, if used, extending vertically between these lower storage decks at intervals fore and aft roughly along the centerline of the vessel. If two or more units are narrow enough to be stored side by side in the storage deck well, they may be floated in and positioned together instead of separately. These barges may be fastened together and on-loaded and off-loaded in that manner onto a storage deck kept free of supporting stanchions. And, two or more of these unfastened barges may be loaded simultaneously to either side of the stanchion row onto a deck having such supporting stanchions. By this procedure, considerably loading and unloading time may be saved.

In the embodiment shown in FIGS. 1–4, the carrier vessel must have means for submerging it to any selected level down to that lowest level necessary for submerging the highest storage deck. Common ballast tanks which can be filled with a conventional liquid, possibly sea water, to cause the overall displacement of the ship to increase or decrease as the ballast tanks are filled or emptied, may be used. They may be positioned throughout the ship so as best to utilize its sensitivity to balance fore and aft and laterally. They must be so positioned that the metacenter of the ship will always be above the ship's center of gravity to assure stability while on-loading and off-loading as well as at sea. In my invention this has been accomplished by designing the position of the ballast tanks so that by flooding the higher ballast tanks the center of gravity of the ship is raised, and conversely, by flooding the lower ballast tanks the center of gravity of the ship is lowered. Thus, sufficient ballast may be taken on properly to submerge the ship for on-loading or off-loading while its stability is assured by the placement of the ballast.

The cargo vessels may be of varying sizes and shapes, the most common of which is the ordinary rectangular river barge. One of the great advantages of this invention is that units of widely different sizes and shapes may be transported in the storage decks.

This embodiment of my invention includes a storage area on each storage deck bounded on both sides by flat, essentially parallel bulkheads set apart by at least half the overall exterior width of the vessel. The uppermost deck storage area, if kept free of support stanchions, will allow a cargo unit almost as wide as this space to enter one end of the storage deck and be floated to its position of storage at the other end of the storage deck completely free of any obstruction to movement. Two or more narrower cargo units, which, when fastened together are not so wide as this stoge space, may be floated on or off and positioned as a unit.

Figure 3:
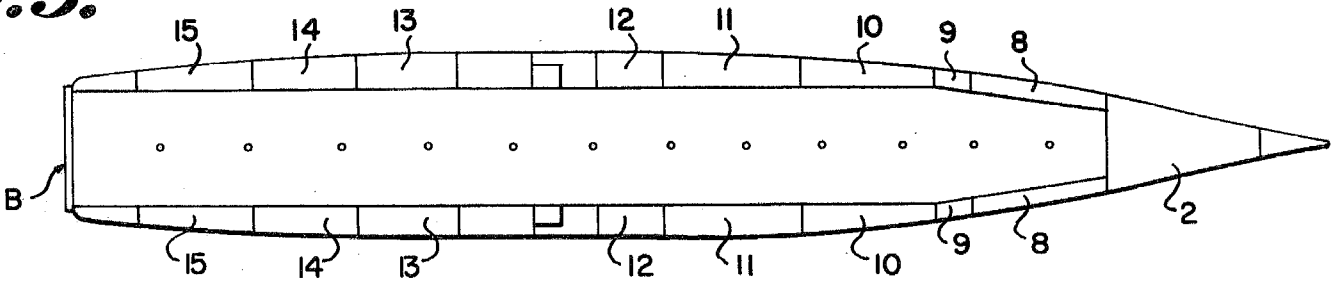
FIG. 3 is a sectional plan similar to FIG. 2 taken at the well deck level.
Figure 4:
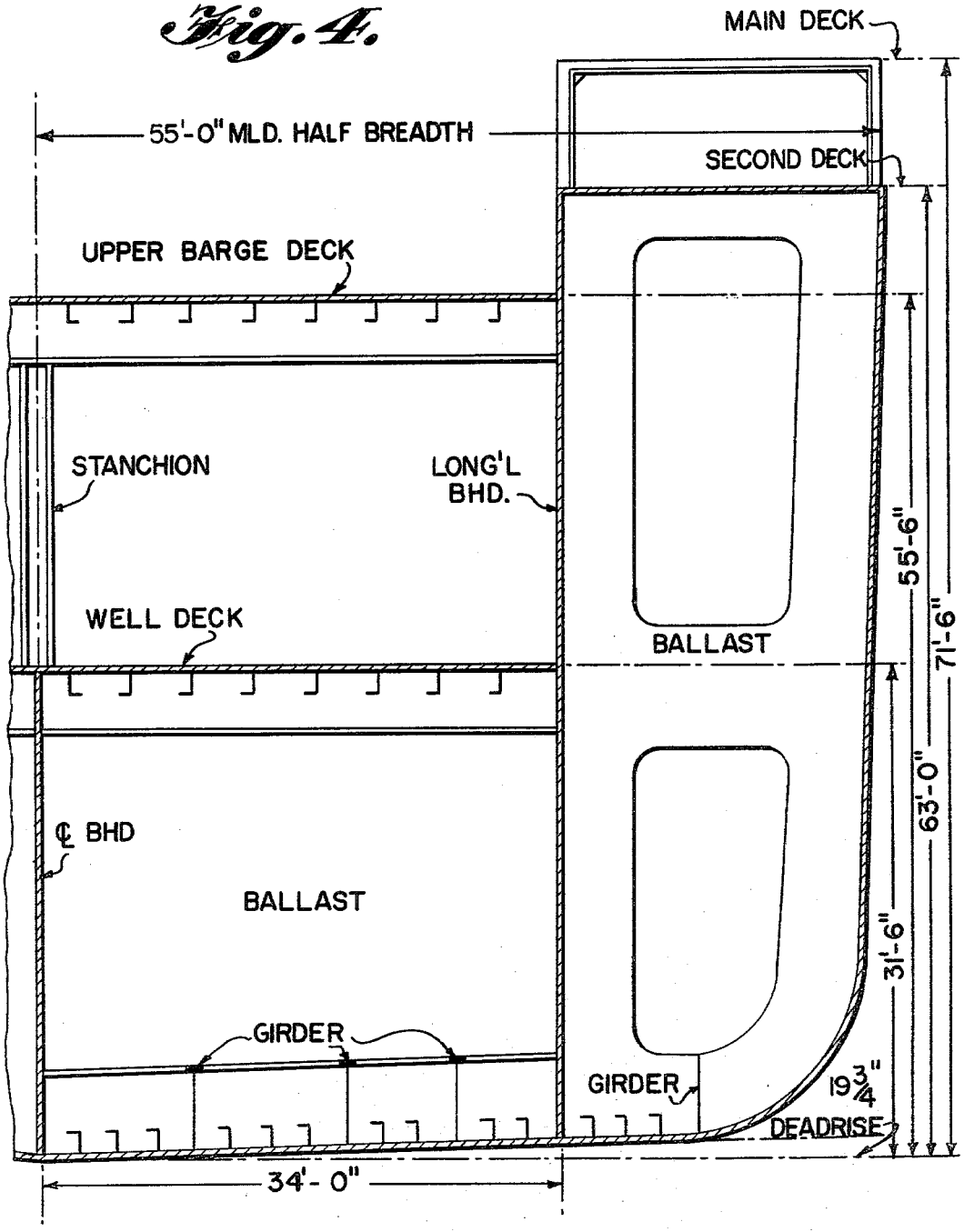
FIG. 4 represents a portion of a vertical, transverse cross-section through a carrier taken in a plane perpendicular to the centerline at a point approximately midship.

Additionally, my invention contemplates a means for watertight sealing at least that storage deck adjacent to the operating water line so that while operating the vessel at sea, there will be no seeping or shipping of water onto the storage deck that could cause a dangerous imbalance in the carrier vessel. Of course, higher decks could be similarly sealed if so desired. Any appropriate means for such sealing can be used, such as a gate, door or doors, collapsible panels, and the like. The means shown in the drawings of FIGS. 1 and 3 is a gate attached to the vessel deck at its lower edge and held in place by means that allow its upper edge to be raised roughly vertically above its lower edge to seal or lowered to a level roughly in a plane with the deck to allow flooding and free floatation of the cargo units over the storage deck plane.

I have selected for illustration in the accompanying drawings a specific example of a carrier vessel according to this embodiment of my invention some 740′ long and 110′ in beam. When trimmed and loaded for an ocean voyage, the vessel would have a draft of some 30′. The lower cargo deck would then be only a foot or two above the water line, while upper cargo deck A would be 24′ higher.

In operation in order to accommodate barges having a normal draft on upper deck A, the vessel would have to be ballasted to a loading draft of some 60′. This deep submergence exceeds the depths normally available in the major ports of the world and it is contemplated that special loading basins will have to be dredged to depths of greater than 60′ at each terminal port serviced by a carrier vessel of this embodiment of my invention. The same deep submergence also poses a severe stability problem during on- and off-loading. It is a feature of my invention that in addition to ballast tanks 1, 2, 3, 4, 5, 6 and 7. I provide high-rise wing tanks 8, 9, 10, 11, 12, 13, 14 and 15 at the sides of the lower cargo well deck to insure this stability and its controlability. It will be noted in FIG. 4 that these wing ballast tanks extend from the bottom of the vessel to a point about 7.5′ above the level of the upper barge deck in the specific example illustrated by FIG. 4.

A specific improvement embodied in this invention is the construction of the essentially rectangular, unobstructed storage deck well A (FIGS. 1 and 2) with its loading opening C (FIGS. 1 and 2) of a width at least as great as the deck well. As the water-tight gate B (FIGS. 1 and 3) is sealed to keep out sea water during a voyage, a similar gate could be supplied the other open decks if desired. The type gate shown is merely a convenient means for sealing the loading opening, and the concept of invention is not limited to this type.

Another specific improvement exemplified by the positioning of the ballast tanks 1–15 (FIGS. 1 and 3) in this embodiment is that by this configuration a vessel having two storage decks as is shown by the drawings of FIGS. 1–4 is thereby made stable while on-loading and off-loading as well as at sea. Each of these ballast tanks is separately fitted with means that will allow them to be filled or emptied independent of such other tanks. Thus, balance can be finely controlled. In order to assure the greatest stability during on-loading operations, the lowest ballast tank may be filled first, with progressive filling up to the highest tank. This procedure would be reversed during off-loading.

In a further embodiment shown in FIGS. 5A–14, I have provided an alternative method of on-loading and off-loading barges by which unusually deep submergence of the vessel may be avoided. By this method, many more ports of call may be utilized, enabling wider use of the overall concept of overseas barge delivery.

Broadly, this further embodiment includes a lifting device, such as an elevator, that can be alternately submerged and raised to the uppermost barge storage deck. FIG. 5A shows such a lifting device in its fully elevated position. The barge elevator platform 62 is fitted with many rollers 130 of the type shown in greater detail by FIG. 14. It is attached to elevator platform hoists 102, 103, 104 and 105 of the type shown in greater detail by FIGS. 8 and 9 by cables 109, 110, 111 and 112. By this arrangement, the barge elevator platform can be raised to a level of the uppermost barge deck (FIG. 5A) and lowered to a level of submergence below the water to a depth sufficient to allow barges to be floated onto it (FIG. 5B).

In FIG. 5B the barge 20 is shown as being floated over the barge elevator platform 62. Once the barge is in position, the platform can be lifted by the hoists 102, 103, 104, and 105 and others utilizing cables 109, 110, 111, 112 and others to a position level with any of the barge decks. In order to load barges on the lower barge deck, the stern gate 106 has to be opened. The means for opening this gate include a stern gate hoist 107 connected to the gate by cable 108. The gate can be opened by lowering it for on-loading and off-loading. FIG. 5B shows barge 21 being carried forward after being loaded in this manner.

FIG. 6 shows the barge elevator platform 62 level with the upper barge deck and indicates the number and positions of roller that cooperate with roller 130 in allowing easy positioning of the barges. FIG. 6 also shows the approximate symmetry of hoists 115, 116, 117, 118 and 119 with 102, 103, 104, 105 and 107 as they are attached to the ship 140.

FIG. 7 shows how rollers may be positioned on the bulkheads of each storage deck as well as on the center stanchions if they are used. Such rollers are shown as 50 and 51 and are positioned so to aid in handling barge 52. The elevator platform hoists referred to as shown in greater detail in FIGS. 8 and 9 include a drive motor 60 used to drive rotatable drum 61 which lifts the elevator platform 1 by means of cable 109. This hoist may be locked or unlocked by means of a rachet wheel 70 and its cooperating piston pawl 71.

FIGS. 10, 11, 12 and 13 show the equipment that can be used to move the barges from the barge elevator platform to their storage position on one of the barge decks where they can be secured for sea.

Figure 12:
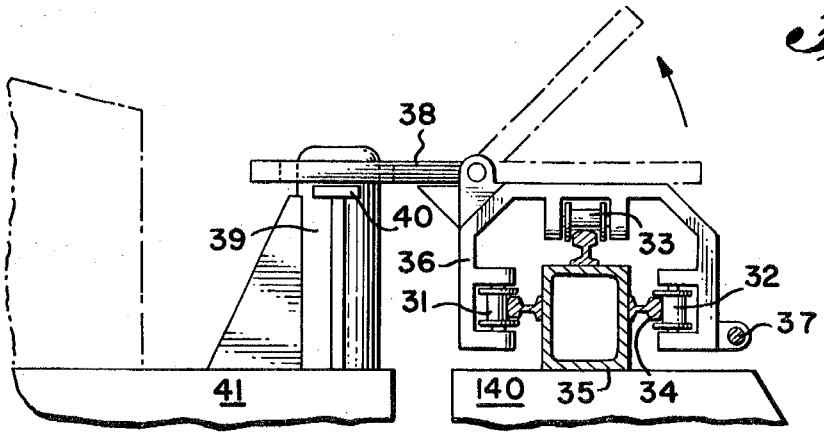
FIG. 12 represents a cross-section view of certain barge handling equipment.
Figure 13:
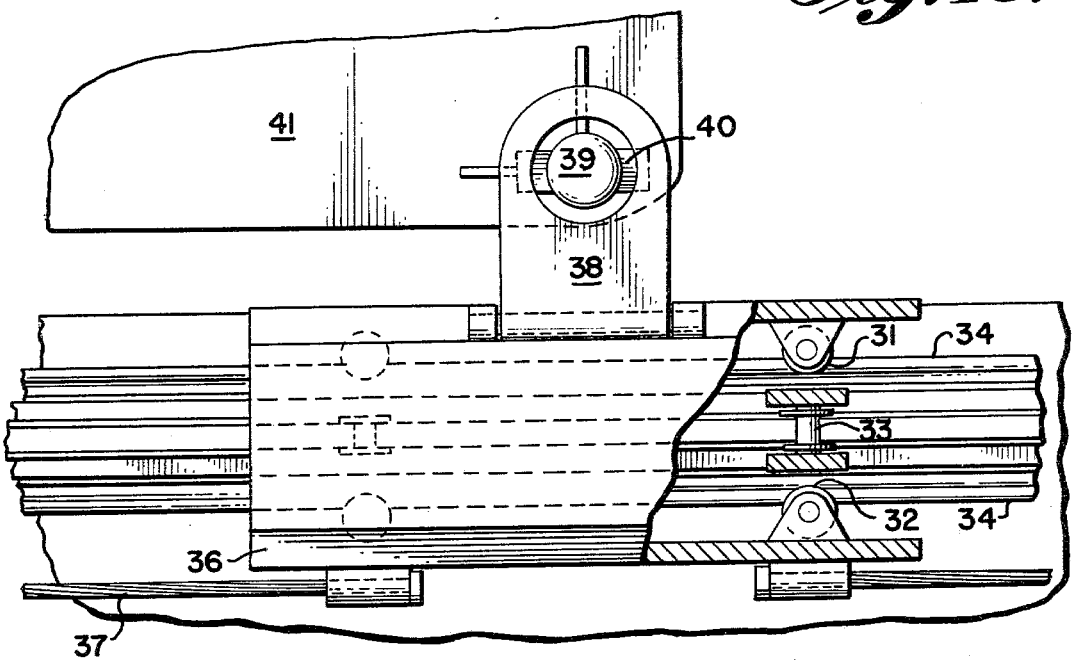
FIG. 13 represents certain barge handling equipment viewed from above.

FIG. 12 shows the detailed components of a carriage which may be used to tow each barge to its respective storage position. This carriage includes a basic structural member 36 to which six rollers (see FIG. 13) are attached so that the axes of rotation of all three lie in a common plane with two of these axes parallel and the third perpendicular to the parallel of the former two. Each of these rollers, three of which are numbered 31, 32 and 33 travel along a rail of the type numbered 34 which is attached to a base member 35 which in turn is fastened to the ship 140.

The basic structural member 36 is controlled and towed by cable 37 and is attached to an individual barge by its pivoted seat 38. When not in use, this seat will rest on top of the basic structural member. When in use, it is flipped over so that the seat 38 engages a corner post 39 of a barge 41 and rests on a supporting plate 40 fastened to that post.

Figure 10:
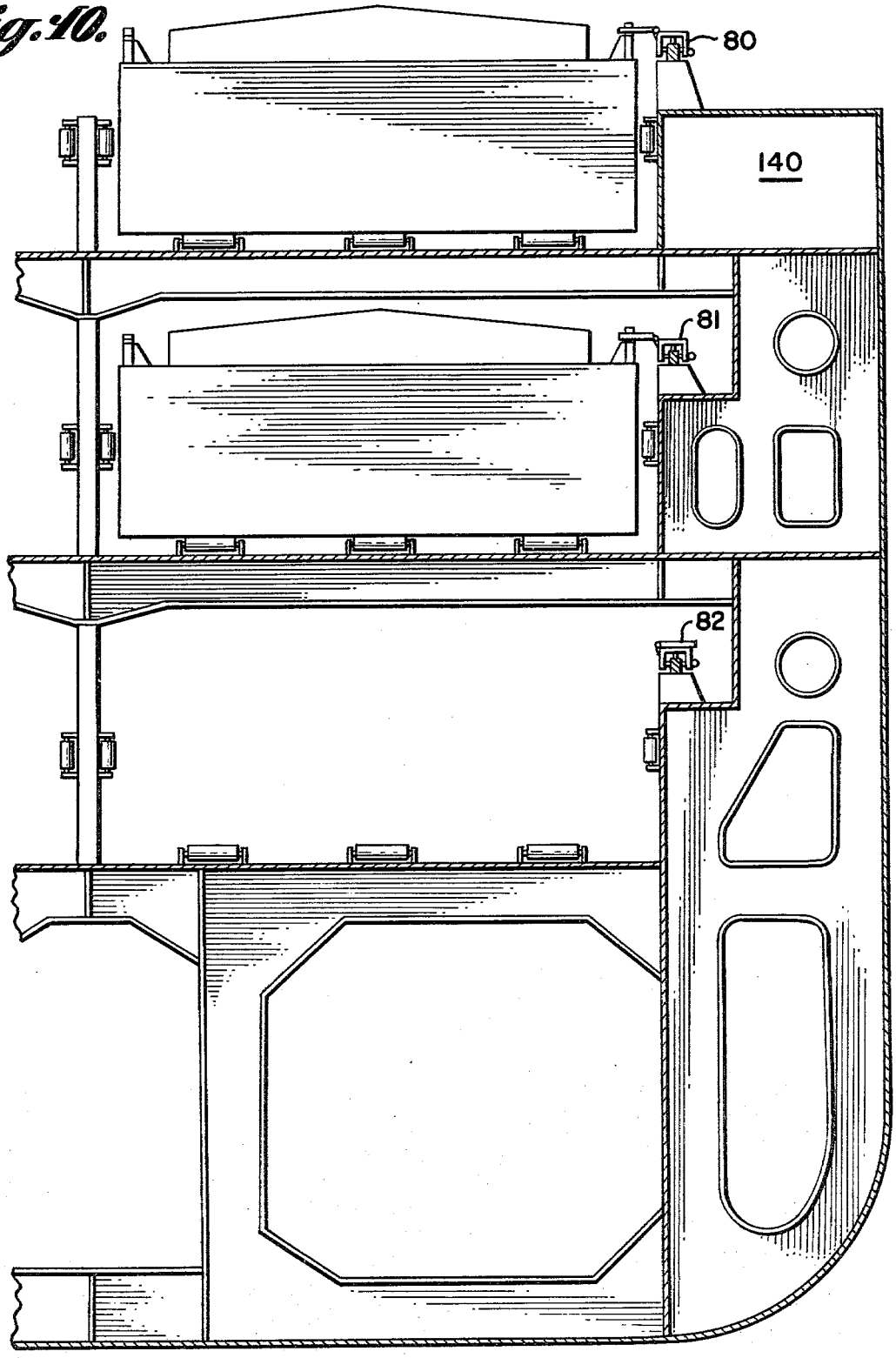
FIG. 10 represents a portion of a vertical, transverse cross-section through a carrier taken in a plane perpendicular to the centerline at a point approximately midship.
Figure 11:
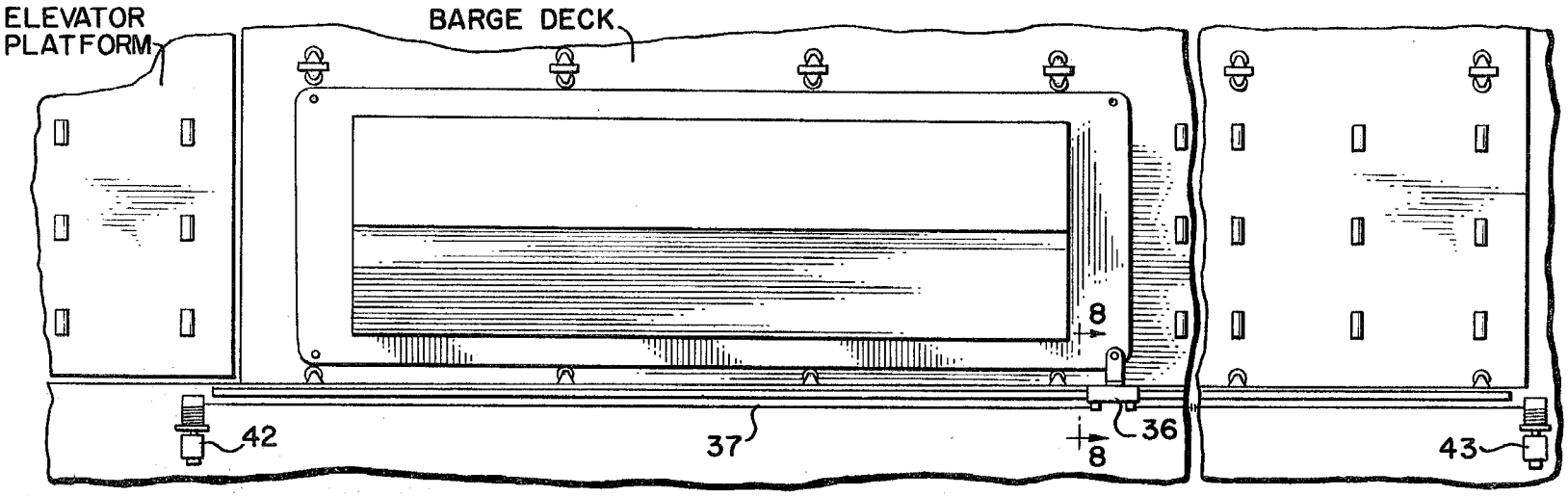
FIG. 11 is a portion of an upper barge deck viewed from above showing certain barge handling equipment.

FIG. 10 shows the positioning of these barge handling carriages 80, 81 and 82 in the structure of the ship 140. FIG. 11 shows how one of these carriages whose basic structural member 36 is towed by cable 37 may be operated by two motors 42 and 43. Once the barge is positioned by these means, it can be secured by any ordinary means.

Figure 14:
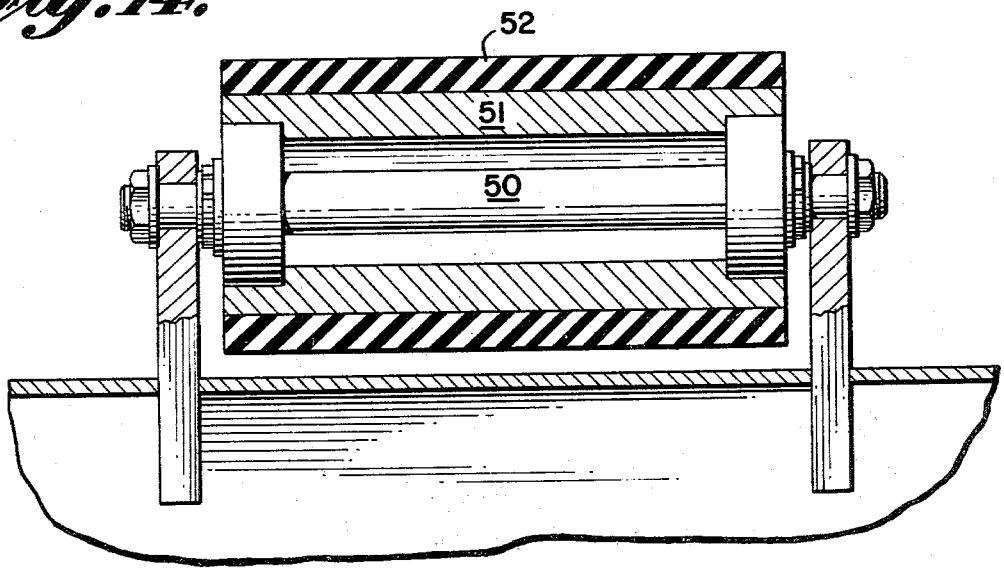
FIG. 14 represents a cross-section view of a roller.

FIG. 14 shows a detail view of a type of roller suitable for use in supporting the weight of the barges. This type roller has a shaft 50, a hub 51 and a tire 52. The remaining parts of this type roller are well known and need no further description.

According to this further embodiment, an ocean-going barge carrier arrives in port and anchors, as it does not need berthing space. It lowers its barge elevator platform to a submergence level deep enough to allow the barges to float freely. These barges are towed away from the stern of the ship and are on their way for delivery. The barge elevator platform is then raised to the level of any of the barge decks, another barge or barges rolled onto the platform by means of one of the barge handling carriers, and the platform re-submerged to allow these barges to be floated away. The process is repeated until the carrier is unloaded. After the carrier is unloaded, it may be re-loaded with other barges in the reverse manner.

In the case of moving barges from the elevator into the interior of the vessel other means may be utilized including hydraulic and mechanical lifting devices which can lift the barges a short height with the barge and the lifting device being towed as a unit to its destination on the deck. On arrival the lifting device will be lowered and the barge secured in place. The lifting device will then be available for yet another barge.

It is claimed:

1. In a marine carrier of the type comprising a hull, a plurality of storage decks arranged one above the other and each having at least one loading opening extending through the carrier hull at the level thereof, elevator means fastened to said hull and capable of submerging, receiving floating barges thereon, and lifting said barges to each respective storage deck level at the loading opening on said deck, means at said opening on each of said decks for engaging and positioning said barges, and support means for said barges on each of said decks over which they may be easily re-positioned.

2. The lifting means of claim 1 which comprises a barge elevator platform attached by cables to elevator platform hoists fastened to said carrier.

3. The engaging and positioning means of claim 1 which comprises a carriage, a cable fastened to said carriage, a track for said carriage, means to move said carriage on said track by said cable, and means for attaching said carriage to a barge.

4. The supporting means of claim 1 which comprises a series of rollers some of which are fastened to said lifting means and others of which are fastened to each of said storage decks sufficient in number to assure that said barge is always supported thereby.

5. In a marine carrier of the type comprising a hull, a plurality of storage decks arranged one above the other and each having at least one loading opening at the level thereof, elevator means fastened to said hull and capable of submerging, receiving floating barges thereon, and lifting said barges to at least one of said deck levels at the loading opening on said deck, means at said opening on said deck for engaging and positioning said barges, and support means for said barges on said deck over which they may be easily repositioned.

* * * * *